United States Patent [19]

Madsen

[11] 4,026,436

[45] May 31, 1977

[54] TIME CONTROLLABLE CIGARETTE DISPENSER

[76] Inventor: Roland X. Madsen, 2341 New Jersey Ave., San Jose, Calif. 95124

[22] Filed: Apr. 9, 1976

[21] Appl. No.: 675,482

[52] U.S. Cl. ..... 221/15; 221/22

[51] Int. Cl.[2] ..... B65H 3/50

[58] Field of Search ..... 221/15, 22, 23, 136, 221/143–149, 203; 206/264, 249, 242; 70/272

[56] References Cited

UNITED STATES PATENTS

| | | | |
|---|---|---|---|
| 2,870,937 | 1/1959 | Telly | 221/15 X |
| 3,186,590 | 6/1965 | Beha et al. | 221/147 |

*Primary Examiner*—Stanley H. Tollberg
*Attorney, Agent, or Firm*—Joel Halpern

[57] ABSTRACT

A time controlled cigarette dispenser includes a pair of cooperable superposed inclined surfaces for serially transferring cigarettes from the upper surface to the lower surface. A rotatable drum receives the cigarettes serially in a predetermined timed sequence from the lower surface and delivers it to a pivotable balance tray from when the smoker may retrieve it for smoking. The drum is motor driven, and upon the deposit of a cigarette on the balance tray the motor is deactivated. Upon retrieval of the cigarette from the balance tray the motor is activated to transfer another cigarette thereto.

6 Claims, 5 Drawing Figures

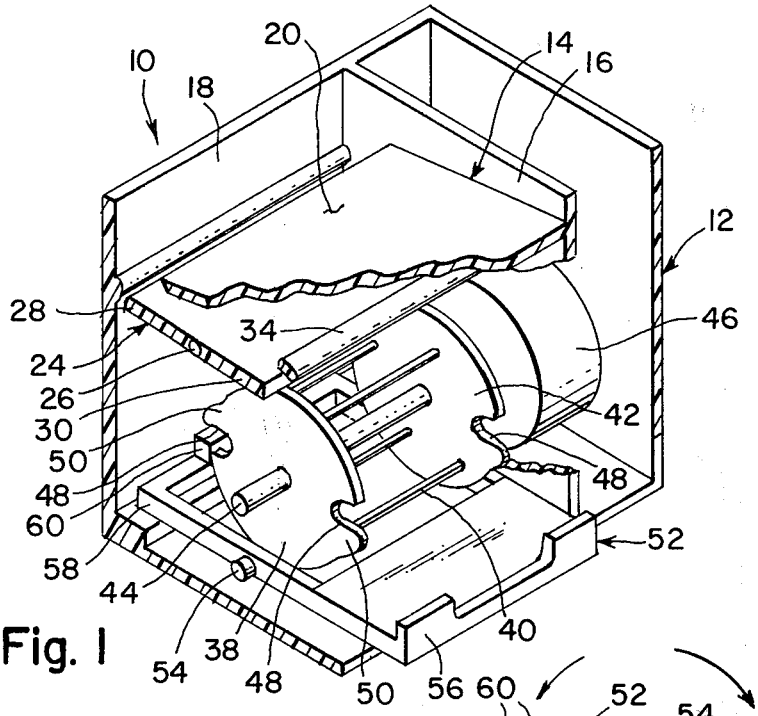
Fig. 1
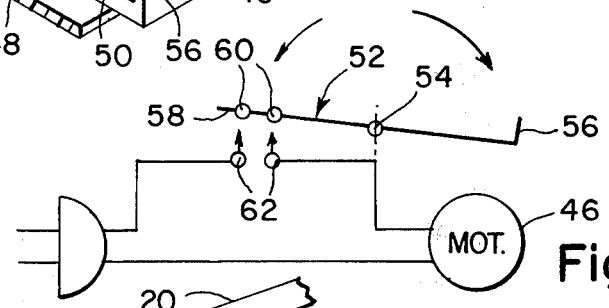
Fig. 2
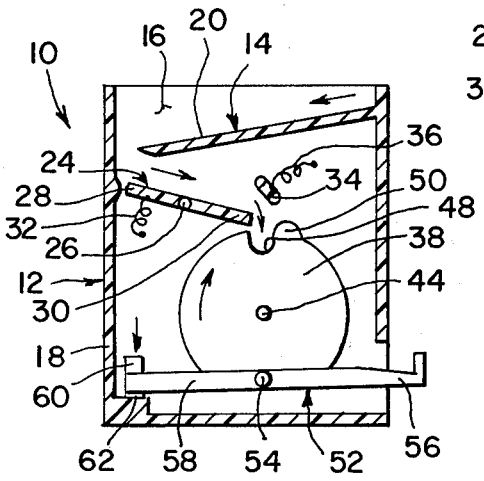
Fig. 3
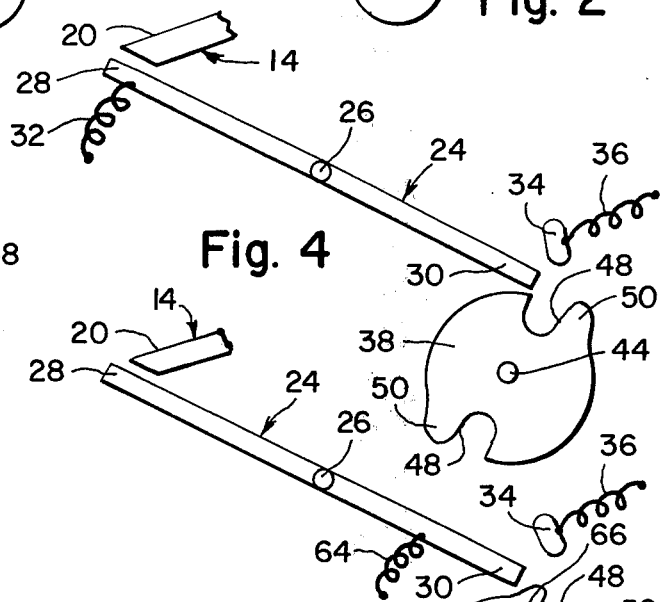
Fig. 4
Fig. 5

TIME CONTROLLABLE CIGARETTE DISPENSER

BACKGROUND OF THE INVENTION

The present invention relates to time controlled cigarette dispensing devices.

Cigarette dispensers of the character to which the present invention relates have been well known heretofore. Generally they include a housing within which there is provided means for storing a supply of cigarettes, means for serially dispensing the cigarettes, and control means for regulating the dispensing of the cigarettes at some predetermined series of delayed time intervals. A typical device is disclosed in U.S. Pat. No. 3,206,957 issued Sept. 21, 1965 to J. Reitzes. Another device of similar character in which the container is provided with a time controlled locking mechanism allowing access to the contents of the container only at predetermined times in disclosed in U.S. Pat. No. 3,750,435 issued Aug. 7, 1973 to Giora Belkin.

It is believed that cigarette dispensing devices of the type whereby cigarettes are dispensed in accordance with a predetermined timed sequence, but where the device remains unlocked and is accessible between the dispensing intervals, is most preferable for psychological reasons. Prior devices of the type powered by an electric motor have been so constructed as to be continuously in operation and have also been relatively complex. Thus, the constant drain on the device's battery has necessitated frequent replacement whereas constructions requiring multiple gearing, for example, have been costly to produce. These factors appear to be two primary reasons why time controlled cigarette dispensers have not been as commerically successful to date as had been anticipated. However, due to the increasing awareness by the general public of the serious health hazards presented by smoking it is of crucial importance that a device of the character described be made available to the public which is not encumbered by the failings of prior devices.

SUMMARY OF THE INVENTION

It is a primary object of the invention to provide a time controlled cigarette dispenser which is reliable and which requires being powered only during the dispensing cycle.

It is another object of the invention to provide a time controlled cigarette dispenser of simple construction and with relatively few moving elements.

Other objects and advantages of the invention will become readily apparent from the following description of the invention.

According to the present invention there is provided a time controlled cigarette dispenser comprising in combination: a housing; a downwardly inclined cigarette transfer tray mounted within the housing having a lower discharge end; a feeder ramp mounted pivotally within the housing having an upper cigarette-receiving end positioned adjacent to and cooperable with the discharge end of the transfer tray; spring means adapted to bias the feeder ramp and transfer tray to act cooperably to serially transfer cigarettes from the tray to the ramp; cigarette retainer means mounted resiliently in the housing adjacent the discharge end of the feeder ramp for controlling the discharge of cigarettes therefrom; a rotatable member having at least one compartment thereon and adapted to be rotated at a predetermined rotational speed to thereby cyclically position the one compartment beneath the discharge end of the feeder ramp to receive a cigarette therefrom and to deliver said cigarette to a balance tray; a balance tray pivotally mounted in the housing and adapted to receive a cigarette from the one compartment and to present same to the smoker; electric motor means for driving the rotatable member at the predetermined rotational speed and control means therefor; and means carried by the balance tray for deactivating the motor upon the deposit of a cigarette upon the tray and for activating the motor upon the removal of the cigarette therefrom.

BRIEF DESCRIPTION OF THE DRAWINGS

In order that the invention may be more fully understood it will now be described, by way of example, with reference to the accompanying drawings in which:

FIG. 1 is a perspective view, partly broken away and partly in cross-section, showing a time controlled cigarette dispenser embodying the invention;

FIG. 2 is a schematic diagram showing the interrelationship between the balance tray and electric motor of the device of FIG. 1;

FIG. 3 is a side elevational view, partly in cross-section, of the device shown in FIG. 1;

FIG. 4 is an enlarged view of the feeder ramp, transfer tray, rotatable member and cigarette retaining means shown in FIG. 3; and FIG. 5 is a view similar to FIG. 4 showing a modified arrangement of such elements.

DETAILED DESCRIPTION OF THE INVENTION

Referring to the drawings there is shown generally a time controlled cigarette dispenser 10. The dispenser includes a housing 12 within which there is located the working elements of the device.

Mounted within the housing is a downwardly inclined cigarette transfer tray 14 which may conveniently be secured to an internal partition 16 that is mounted on a side wall 18 of the housing. The transfer tray desirably is given a flat upper surface 20 and is shown as terminating in a lower discharge end which is in spaced relation to side wall 18 of the housing. Thus, a supply of cigarettes may be stored on the tray for ultimate dispensing to the smoker.

A feeder ramp 24 is positioned beneath the transfer tray and is pivotally mounted such as by means of a pivot pin 26. For a reason which will become clear, the feeder ramp is pivotally mounted about its pivotal axis such that its upper cigarette-receiving end 28 is closer thereto than the lower discharge end 30. A fine coil spring 32 is secured to the feeder ramp so as to bias the uper end thereof away from the discharge end of the transfer tray to thereby permit the discharge of a cigarette therefrom. It will be recognized that upon the discharge of a cigarette from the transfer tray to the receiving end of the feeder ramp it will roll down the feed ramp and effectuate a pivotal movement of the feeder ramp such that the upper end is brought into abutting relation with the discharge end of the transfer tray to prevent the discharge of another cigarette until the cigarette already stationed on the feeder ramp is discharged. The dimensions of the levers, into which the feeder ramp is divided by the pivot pin, are predetermined to permit the development of a force moment at the discharge end of the ramp when a cigarette is positioned there at which is sufficient to overcome the force of coil spring 32 in order to effectuate the pivotal movement of the feeder ramp to block the transfer of a cigarette from the transfer tray.

At least one retaining 34 is mounted in the housing adjacent the discharge end of the feeder ramp and is biased by spring means 36, which may either be a coil spring or flat spring, to block the discharge of a cigarette stationed for discharge on the feeder ramp.

A rotatable member 38 is mounted rotatably within the housing and preferably takes the form of a circular disk. For convenience it may be connected by means of a plurality of spoke members 40 with a second disk 42. Both of such disks are drivably connected, such as by means of a central shaft 44, with an electric motor 46. The motor may be any suitable electric motor which can be fitted with a speed reducer (not shown) so as to afford the desired range of driving speeds for the rotatable member. Extremely slow speeds are most desirable so that the rotatable member is adapted to withdraw from the feeder ramp a cigarette at timid intervals as may be considered appropriate in order to gradually decrease the smoker's dependence upon cigarettes. A recommended range of rotational speeds for the rotatable member is such as to permit the withdrawal of a cigarette every thirty minutes to the withdrawal of a cigarette every two hours.

The rotatable member may comprise a single disk of sufficient axial extent to support a cigarette received from the feeder ramp. It will be seen that the peripheral surface of the rotatable member is formed with at least one compartment 48 therein adapted to receive and support therein in axial relationship to the rotatable member a cigarette discharged from the feeder ramp. Preferably two or more of such compartments are formed in spaced relation about the periphery of the rotatable member. As viewed in FIG. 1 of the drawings, the rotatable member is rotated in a clockwise direction so that one of the compartments is cyclically positioned beneath the discharge end of the feeder ramp to receive a cigarette therefrom.

As shown in the drawings the compartments may simply consist of one or more recesses formed in the periphery of the rotatable member. It will be observed that a cam projection 50 is formed on the rotatable member adjacent to and in advance of each of the compartments. The purpose of the cam projection is to engage with the retaining element 34 to force same away from the discharge end of the feeder ramp to thereby permit the discharge of the cigarette stationed thereat. Thus, after the rotatable member has rotated to a position where cam 50 is no longer engaged with the retaining element the spring 36 will return the retaining element to close proximity with the discharge end of the feeder ramp to prevent the discharge of another cigarette until the next succeeding cam projection engages the retaining element to force it away from the feeder ramp.

As may be seen most clearly from FIGS. 2 and 3, a balancing tray 52 is mounted pivotally in the housing at the bottom thereof such as by means of a pivot pin 54. The tray is thus divided into a cigarette receiving lever segment 56 and a lever segment 58 which carries electrical contact means 60 cooperable with electrical contact means 62 in the motor circuit. It will thus be seen that when a cigarette is deposited upon segment 56 from one of the compartments of the rotatable member 38 the balance tray is caused to pivot about the pivot pin 54 to thereby break the electrical connection between contact means 60 and 62. The electric motor is thereby deactivated. However, upon the removal of the cigarette from the balancing tray by the smoker the tray is caused to pivot back to its original position to reestablish the electrical connection between the contact means 60 and 62 and thereby reactivate the electric motor. In this manner the operation of the electric motor is made continuous only during the dispensing cycle. Once the cigarette has been transferred to the balancing tray for presentation to the smoker there is no longer any need to keep the motor running. If desired, and in order to accelerate restoration of the balancing tray to its original position in which the contact means 60, 62 are electrically connected it may be desirable to provide a light restoring spring which exerts sufficient force upon the tray to speedily pivot to its original position. Such spring (not shown) should possess a sufficiently low strength as to enable a cigarette at the end of segment 56 to effectuate pivotal movement of the tray into the position shown in FIG. 2 where the motor circuit is broken.

A modification of the arrangement shown in FIG. 4 is depicted in FIG. 5 where a spring 64 is secured to the feeder ramp for the purpose of biasing the receiving end of the feeder ramp 24 into abutting relation with the discharge end of the transfer tray 14 so as to block the discharge of a cigarette therefrom. A second cam projection 66 is formed on the rotatable member 38 immediately to the rear of each compartment. Cam 66 is given a rise less than that of cam 50 such that when the member 38 rotates there will be no engagement of the retaining element by cam 66. The rise of cam 66 should, however, be sufficient to engage with the lower surface of the discharge end of the feeder ramp to effectuate pivotal movement of the feeder ramp against the force of spring 64. Such pivotal movement of the feeder ramp results in an opening of a passage between transfer tray 14 and the upper end of the feeder ramp to permit the transfer of a cigarette from the transfer tray to the feeder ramp from which point of the ramp it will roll downwardly until arrested by the retaining element as described above in conjunction with FIG. 4. The slope of cam 66 is dimensioned relative to that of cam 50 in order to insure that the cigarette transferred from tray 14 will roll down the ramp and be discharged therefrom together with the preceding cigarette. There must be adequate time for cam 50 to pass and release the retaining element so that it blocks the discharge of the second cigarette.

From the foregoing it will be seen that an improved time controlled cigarette dispenser has been provided which affords advantages not possible with prior devices of the same character. The availability of the device of this invention is expected to furnish valuable assistance in the drive to curtail cigarette smoking.

What is claimed is:

1. A time controlled cigarette dispenser comprising in combination:

a housing;

a downwardly inclined cigarette transfer tray mounted within said housing having a lower discharge end;

a feeder ramp mounted pivotally within said housing having an upper cigarette-receiving end positioned adjacent to and cooperable with said discharge end of the transfer tray;

spring means adapted to bias said feeder ramp and enable said feeder ramp and transfer tray to act cooperably to serially transfer cigarettes from said tray to said ramp;

cigarette retainer means mounted resiliently in said housing adjacent the discharge end of said feeder ramp for controlling the discharge of cigarettes therefrom;

a rotatable member having at least one compartment thereon and adapted to be rotated at a predetermined rotational speed to thereby cyclically position said one compartment beneath the discharge end of said feeder ramp to receive a cigarette therefrom and to deliver said cigarette to a balance tray;

a balance tray pivotally mounted in said housing and adapted to receive a cigarette from said one compartment and to present same to the smoker;

electric motor means for driving said rotatable member at said predetermined rotational speed and control means therefor;

and means carried by said balance tray for deactivating said motor upon the deposit of a cigarette upon said tray and for activating said motor upon the removal of said cigarette therefrom.

2. A time controlled cigarette dispenser according to claim 1, wherein the pivotal axis of said feeder ramp is horizontally disposed within said housing and is located closer to the cigarette-receiving end of the feeder arm than the discharge end thereof, spring means being secured to said feeder ramp to normally bias said cigarette-receiving end thereof away from the discharge end of the transfer tray to permit the discharge of a single cigarette from said tray to said ramp, the distance of the respective ends of said feed ramp to said pivotal axis being selected to develop a force moment at the discharge end due to the weight of a first cigarette thereat sufficient to effect pivotal movement of the feeder ramp against the bias of said spring means to thereby block the discharge of another cigarette from said transfer tray until said first cigarette is discharged from said feeder ramp.

3. A time controlled cigarette dispenser according to claim 1, wherein said cigarette retainer means includes at least one resiliently mounted element normally biased into the path of cigarette discharge to prevent the discharge of a cigarette from said feeder ramp.

4. A time controlled cigarette dispenser according to claim 3, wherein said rotatable member comprises at least one disk and said compartments comprise at least one recess in the periphery of each of said disks, cam means being formed on said disk periphery adjacent to and in advance of each said recess cooperable with said retainer means upon rotation of the rotatable member to thereby move said retainer means against its biasing force and permitting the discharge of the cigarette stationed at the discharge end of the feeder ramp into the underlying recess.

5. A time controlled cigarette dispenser according to claim 4, including second cam means is formed on said disk periphery adjacent to and rearwardly of each said recess cooperable with the underside of the discharge end of said feeder ramp upon rotation of said rotatable member to thereby pivot said feeder ramp against the bias of the said spring means and permit the discharge of a single cigarette from said transfer tray to said feeder ramp.

6. A time controlled cigarette dispenser according to claim 1, wherein said balance tray is pivotally mounted at approximatey the midpoint thereof to divide said balance tray into a first cigarette-receiving lever segment and a second lever segment, electrical contact means being carried by said second segment cooperable with electrical contact means in the motor circuit, whereby the deposit of a cigarette on said cigarette-receiving lever segment develops a sufficient force movement to pivot the balance tray and break the electrical connection between said electrical contact means and deactivate the motor, and the removal of said cigarette from said balance tray results in pivotal movement of said balance tray to the original position thereof so as to reestablish the electrical connection between said electrical contact means and activate the motor.

* * * * *